US005479687A

United States Patent [19]

Sawdon

[11] Patent Number: 5,479,687

[45] Date of Patent: Jan. 2, 1996

[54] APPARATUS FOR JOINING SHEETS OF MATERIAL

[75] Inventor: Edwin G. Sawdon, St. Clair, Mich.

[73] Assignee: BTM Corporation, Marysville, Mich.

[21] Appl. No.: 189,580

[22] Filed: Jan. 31, 1994

[51] Int. Cl.[6] ..... B23P 11/00

[52] U.S. Cl. ..... 29/243.5; 29/283.5; 72/465

[58] Field of Search ..... 29/21.1, 436, 505, 29/521, 522.1, 243.5, 283.5, 798; 72/481, 465, 393, 353.4

[56] References Cited

U.S. PATENT DOCUMENTS

| | | | |
|---|---|---|---|
| 1,404,126 | 1/1922 | Krause | 72/481 |
| 3,468,527 | 9/1969 | Mather | 267/167 |
| 3,690,141 | 9/1972 | Brownbill | 72/393 |
| 4,208,776 | 6/1980 | Schleicher | 29/243.5 |
| 4,757,609 | 7/1988 | Sawdon . | |
| 4,825,525 | 5/1989 | Obrecht et al. | 29/243.5 |
| 4,905,362 | 3/1990 | Obrecht et al. | 29/243.5 |
| 4,910,853 | 3/1990 | Sawdon . | |
| 5,027,503 | 7/1991 | Sawdon . | |
| 5,150,513 | 9/1992 | Sawdon . | |
| 5,177,861 | 1/1993 | Sawdon . | |

FOREIGN PATENT DOCUMENTS

| | | | |
|---|---|---|---|
| 62-148039 | 7/1987 | Japan . | |
| 62-148036 | 7/1987 | Japan . | |
| 1299669 | 3/1987 | U.S.S.R. | 29/283.5 |

*Primary Examiner*—David P. Bryant
*Attorney, Agent, or Firm*—Harness, Dickey & Pierce

[57] ABSTRACT

An apparatus for joining sheets of material employs a die assembly having an anvil peripherally bordered by a plurality of movable die segments and a spring which urges the die segments radially toward the anvil. In a further aspect of the present invention, the spring is a coiled and canted spring. In another aspect of the present invention, the spring secures the die segments within an outer sleeve. In yet another aspect of the present invention, a unique die retainer has provisions for retaining a die assembly and for fastening such to a work surface.

59 Claims, 5 Drawing Sheets

APPARATUS FOR JOINING SHEETS OF MATERIAL

BACKGROUND AND SUMMARY OF THE INVENTION

This invention relates generally to an apparatus for joining sheets of material and specifically to a die assembly and retainer used therein.

It is old in the art to join multiple pieces of sheet metal by punching or otherwise manipulating them to cause these sheets to be deformed into an interlocking relationship in a localized area. However, such joints have traditionally required the shearing of the sheet material and hence are not suitable for leak proof applications unless a sealant is applied. The formation of such joints is also frequently destructive of the corrosion resistance of coated materials. In addition, the known apparatuses for forming the joints are frequently complex in design. This complexity increases the cost of the equipment, as well as the energy required for operation.

More recently, the inventor of the present invention has developed an apparatus for producing more cost effective and aesthetically pleasing leak proof and lanced joints. These are known within the industry as Tog- L-Loc® and Lance-N-Loc® joints which can be obtained from the assignee of the present invention. These improved joints are disclosed within U.S. Pat. No. 5,150,513 which issued on Sep. 29, 1992 and U.S. Pat. No. 5,177,861 which issued on Jan. 12, 1993, both of which are incorporated by reference herein.

Moreover, the use of coiled springs to inwardly retain a plurality of movable die pieces against an anvil for joining sheets of material is shown in Japanese patents 148036 entitled "Joining Device For Thin Metallic Plate" and 148039 entitled "Joining Device For Metallic Sheet." However, in both of these devices, the coiled spring is not canted. Furthermore, an outer sleeve is not shown surrounding the spring and movable die pieces.

In accordance with the present invention, the preferred embodiment of a new and useful apparatus for joining sheets of material employs a die assembly having an anvil peripherally bordered by a plurality of movable die segments and a spring which urges the die segments radially toward the anvil. In a further aspect of the present invention, the spring is a coiled and canted spring. In another aspect of the present invention, the spring secures the die segments within an outer sleeve. In yet another aspect of the present invention, a unique die retainer has provisions for retaining a die assembly and for fastening such to a work surface.

The apparatus of the present invention is advantageous over conventional devices in that a plurality of die segments and a spring can be assembled to an anvil in a more cost effective, reliable and more durable manner. Furthermore, the spring and die segment construction of the present invention allows for quicker and easier disassembly and is self cleaning of undesirable foreign matter. Moreover, a spring serves to reliably retain a plurality of die segments within an outer sleeve regardless of the attitude of the die assembly. A canted spring of the present invention also allows a die assembly to be more compact in a radial direction as compared to prior uncanted spring devices. Furthermore, an outer casing substantially surrounds a plurality of die segments and a spring thereby protecting the die segments and spring from foreign matter and from inadvertent abuse. The specific mounting construction of die retainers of the present invention are also advantageous over traditional devices since the present invention provides for a secure yet easily removable die retainer which can be fastened to a variety of work surfaces. Additional advantages and features of the present invention will become apparent from the following description and appended claims, taken in conjunction with the accompanying drawings.

DETAILED DESCRIPTION OF THE PREFERRED EMBODIMENTS

Figure 1:
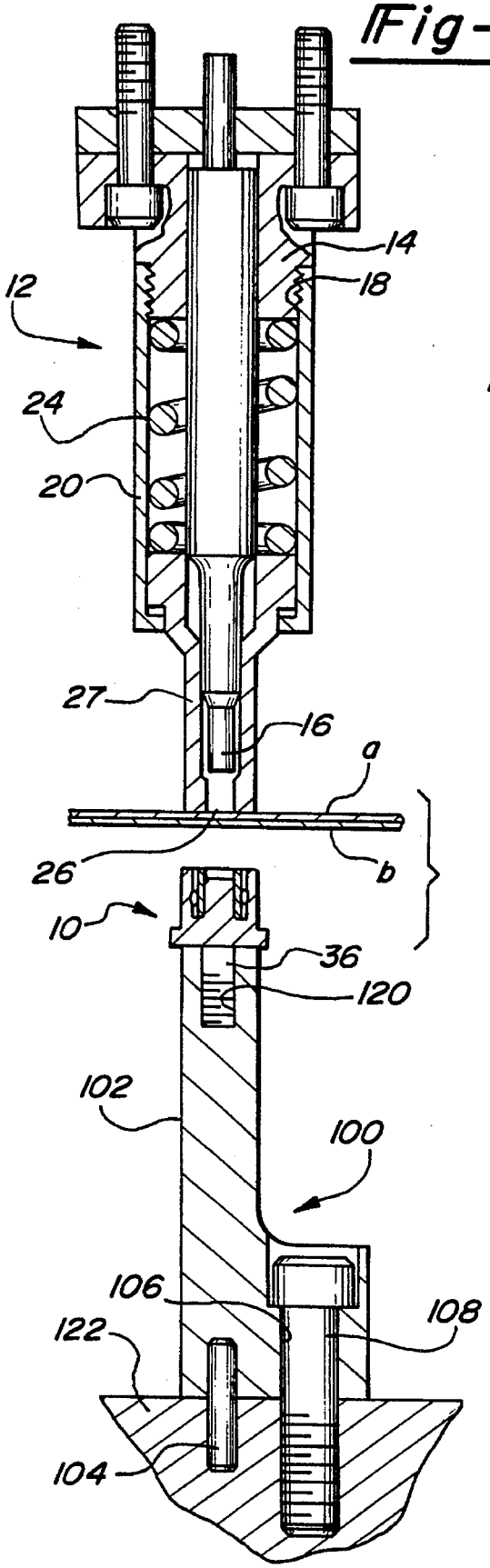
FIG. 1 is a front elevational view, partially in section, showing an apparatus incorporating the principles of a first preferred embodiment of the present invention, illustrated in its retracted position.
Figure 2:
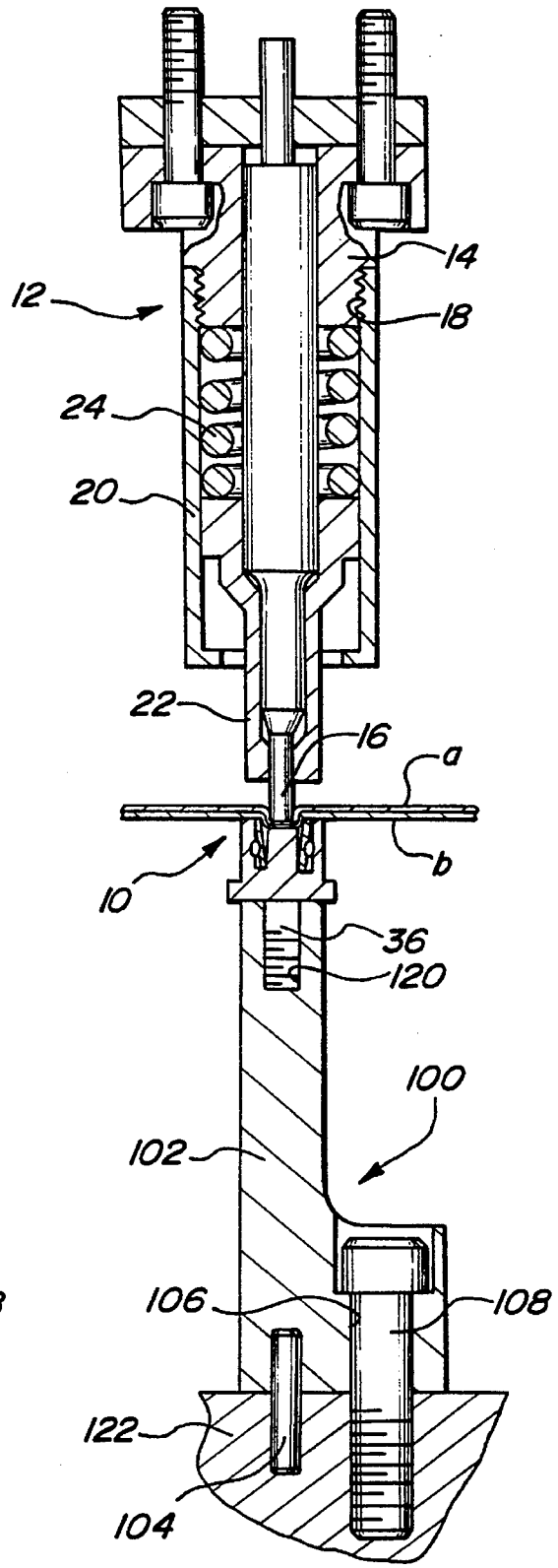
FIG. 2 is a view, similar to that of FIG. 1, showing the first preferred embodiment of the apparatus of the present invention in its advanced position.

Referring to FIGS. 1 and 2, a preferred embodiment of an apparatus of the present invention for joining sheets of material is comprised of a die assembly 10 and a punch assembly 12 for joining two pieces of sheet metal or other deformable sheet material, such as a deformable polymeric material, as indicated at a and b respectively. Although only two pieces of sheet material are shown, it is to be understood that more than two pieces may be joined in accordance with the principles of the present invention, depending upon the composition and thickness of the sheet material in question. It is envisioned that the most common materials to be joined by the present invention will include sheet stock materials, such as aluminum, galvanized, brass, steel, etc., both coated and uncoated. The invention is particularly useful and advantageous in joining sheet material items composed of different materials where such dissimilar materials cannot be welded to one another.

Punch assembly 12 is of conventional construction, including a punch body 14 mounting a circular punch 16 and having a threaded portion 18 for threadably supporting a stripper retainer 20. Disposed within stripper retainer 20 is a stripper 22 biased to the stripping position, illustrated in FIG. 1, by means of coiled stripping springs 24. Punch 16 preferably has a smooth flat working surface 26, with a small radius at the edge.

Figure 4:
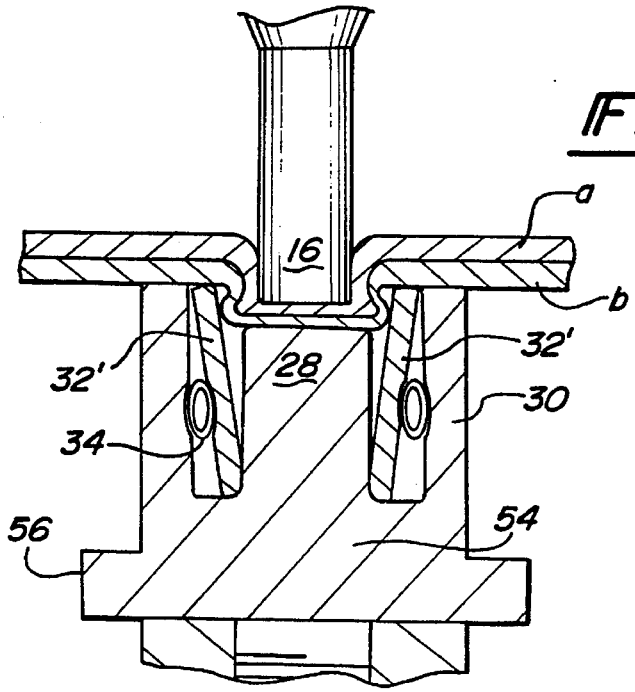
FIG. 4 is an enlarged fragmentary front elevational view, partially in section, showing a joint created by the apparatus of the present invention of Figure 2.
Figure 6:
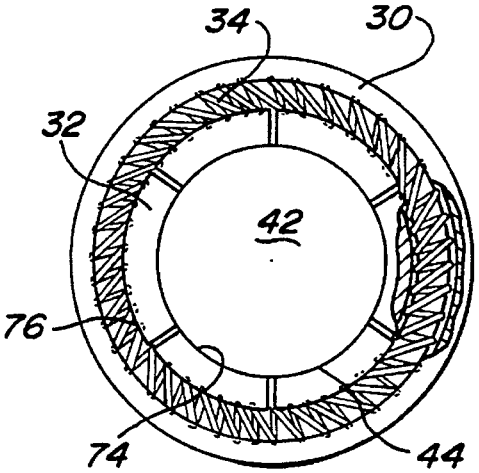
FIG. 6 is an enlarged top elevational view, with portions broken away therefrom, showing the first preferred embodiment of the die assembly of FIG. 5, employed in the apparatus of the present invention.
Figure 5:
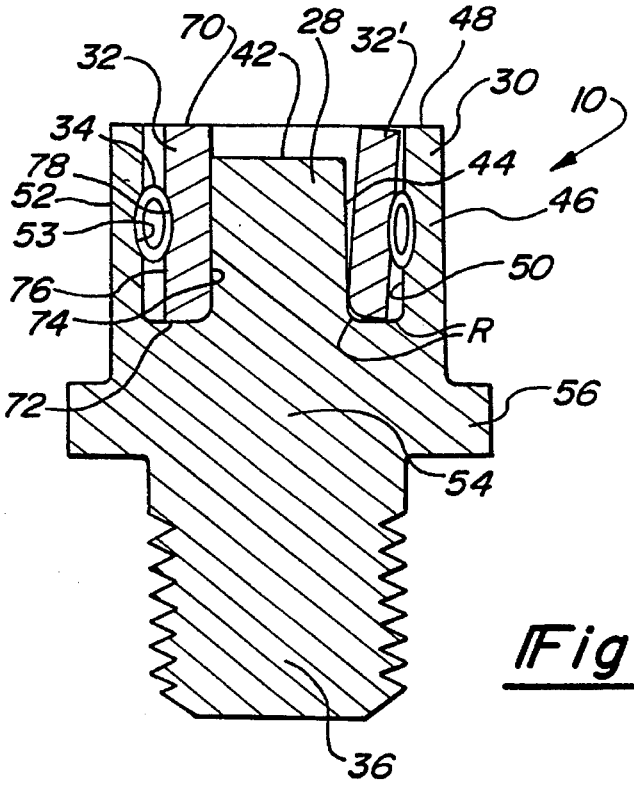
FIG. 5 is an enlarged sectional view, taken along line 5—5 of FIG. 3, showing the first preferred embodiment of the die assembly employed in the apparatus of the present invention.

As can best be observed in FIGS. 4 through 6, die assembly 10 is comprised of an anvil 28, an outer sleeve 30, a plurality of die segments 32, a spring 34 and a threaded shaft 36. Anvil 28 is shown as a substantially cylindrical member having a working surface 42 and a peripheral surface 44. Of course, anvil 28 may have a variety of other peripheral and working surface shapes and patterns depending upon the specific joint application. Sleeve 30 has a substantially annular upper portion 46 with an upper edge 48, an inner surface 50 and an outer surface 52. Upper portion 46 of sleeve 30 mates with anvil 28 at a base portion 54. Outer surface 52 of sleeve 30, proximate with base portion 54 has a hexagonal configuration at 56 thereby providing a gripping surface for a wrench or socket tool. A substantially elliptical channel 53 transversely runs within inner surface 50 of sleeve 30. Of course, outer sleeve 30 may be a separately machined part from anvil 28 and threadably joined thereto.

Each die segment 32 has a substantially arcuate cross sectional configuration matching peripheral surface 44 of anvil 28. Each die segment 32 is defined by a shoulder surface 70 and an oppositely disposed bottom surface 72, both of which are joined by an inside surface 74 and an outside surface 76. A substantially elliptical groove 78 circumferentially runs within outside surface 76 of each die segment 32.

Spring 34 is a canted coiled spring made from coated music wire or the like. Spring 34 circumferentially surrounds die segments 32 when installed within die assembly 10. Spring 34 further secures die segments 32 within die assembly 10 by engagement with groove 78 and channel 53. Thus, during the Lance-N-Loc® or the Tog-L-Loc® deformable joining of materials a and b, die segments 32 are transversely or radially moved to positions 32'. In positions 32', die segments 32 expand spring 34 against sleeve 30. This spring expansion is simplified by use of a canted type spring 34. When the material joining is completed and removed from die assembly 10, spring 34 radially urges die segments 32 inward toward anvil 28.

Figure 3:
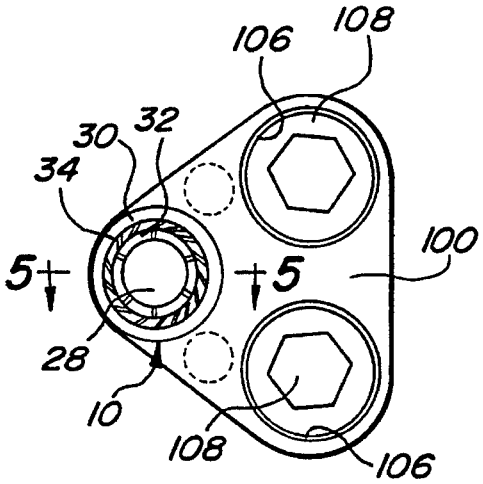
FIG. 3 is a top elevational view showing the first preferred embodiment of a die assembly and die retainer employed in the apparatus of the present invention of FIG. 1.

A die retainer 100 is illustrated in FIGS. 1 through 3. Die retainer 100 has an elongated cylindrical tower 102, a locating pin 104 and a pair of apertures 106 for receiving corresponding fastening bolts 108. Tower 102 has a threaded receptacle 120 for enmeshed engagement of threaded shaft 36 of die assembly 10. Bolts 108 and locating pin 104 serve to retain and secure die retainer 100, and in turn, die assembly 10, to a work surface 122 such as a C-frame clamping device for a standard press or to a table top. Tower 102 and apertures 106 are triangularly oriented in relation to one another as viewed in FIG. 3.

Figure 8:
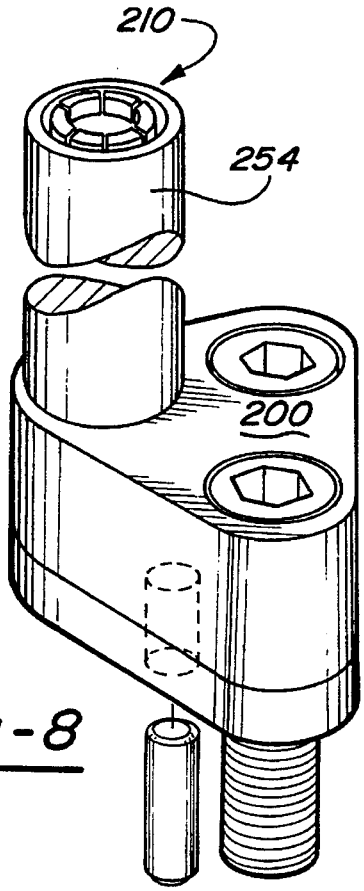
FIG. 8 is a perspective view showing the second preferred embodiment of the die assembly and die retainer of FIG. 7 employed in the apparatus of the present invention.
Figure 7:
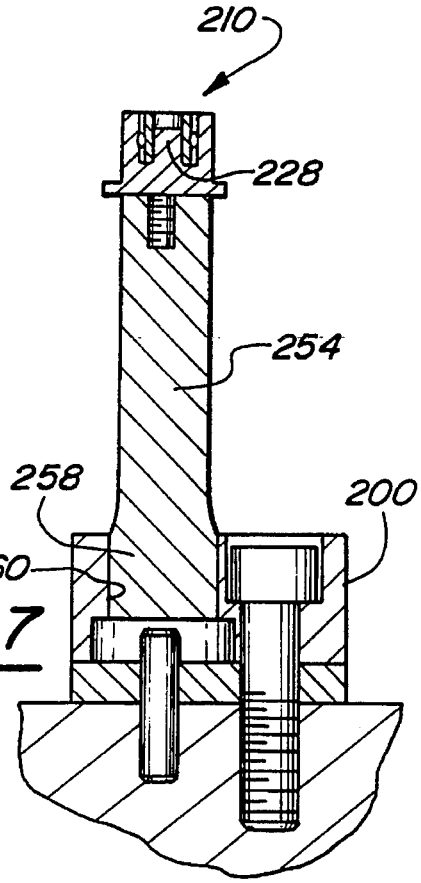
FIG. 7 is a sectional view showing a second preferred embodiment of a die assembly and die retainer employed in the apparatus of the present invention of FIG. 1.

A second preferred embodiment of the apparatus of the present invention is shown in FIGS. 7 and 8. In this embodiment, die assembly 210 is substantially similar to that of the first embodiment, however, a base portion 254 is longitudinally lengthened so as to extend from below anvil 228 to a bulged portion 258. Bulged portion 258 is press fit within an unthreaded receptacle 260 of a die retainer 200. Of course, bulged portion 258 can be threadably enmeshed with receptacle 260 or supplemental bolts may be provided.

Figure 10:
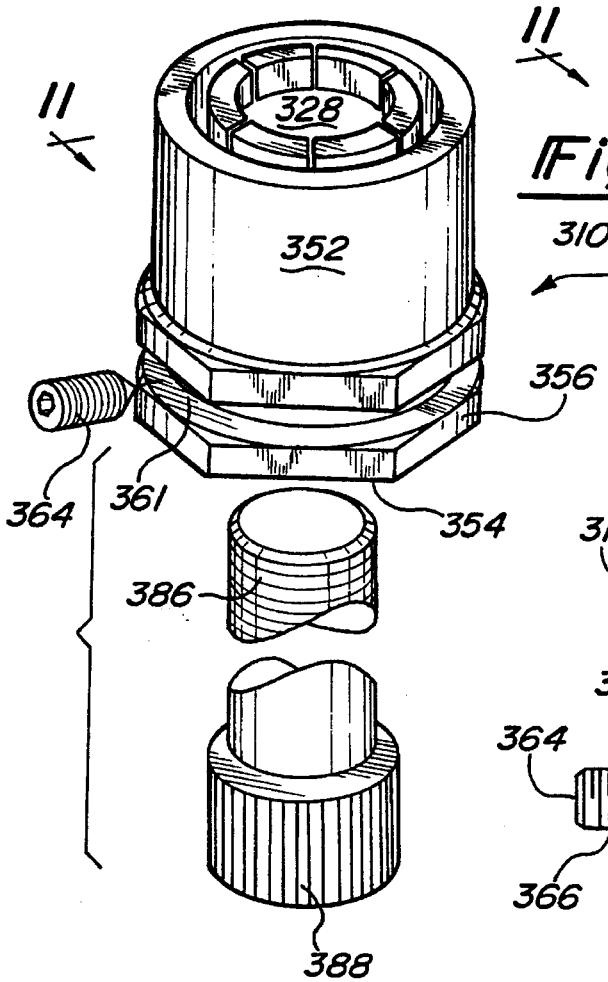
FIG. 10 is a perspective view showing the third preferred embodiment of the die assembly of FIG. 9 employed in the apparatus of the present invention with fasteners exploded away therefrom.
Figure 11:
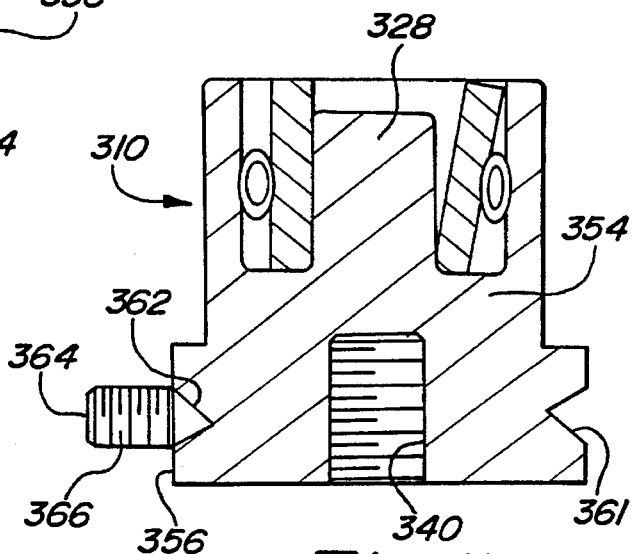
FIG. 11 is an enlarged sectional view, taken along line 11—11 of FIG. 10, showing the third preferred embodiment of the die assembly employed in the apparatus of the present invention.
Figure 9:
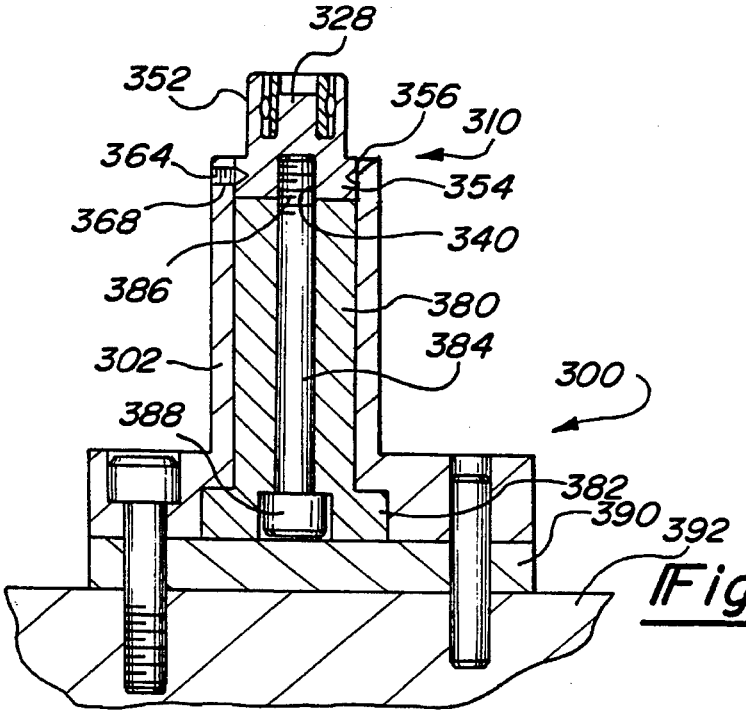
FIG. 9 is a sectional view showing a third preferred embodiment of a die assembly and die retainer employed in the apparatus of the present invention of FIG. 1.

FIGS. 9 through 11 illustrate a third preferred embodiment of the apparatus of the present invention. Die assembly 310 is substantially similar to that of the prior embodiment constructions, however, an internally threaded passage 340 is coaxially aligned with an anvil 328 within a base portion 354. Base portion 354 further has a hexagonal configuration around an outer surface 352 at 356. A V-shaped peripherally running indentation 361 is disposed within hexagonally-shaped surface at 356 for engagement with a conically pointed tip 362 of a set screw 364. Set screw 364 further has a threaded segment 366 which is in enmeshed engagement with a threaded orifice 368 transversely extending through an upper portion of a tower 302 of a die retainer 300. A hollow central insert 380 with a transversely oriented flange 382 is substantially disposed within tower 302 of die retainer 300. A die-securing bolt 384 has a threaded shaft 386 and a head 388. Shaft 386 enmeshably engages with passage 340 of die assembly 310 while head 388 is snugly secured within flange 382 of central insert 380. It should be noted that either set screw 364 or bolt 384 may be used but preferably not both. Thus, die assembly 310 is securely fastened to die retainer 300 and, in turn, to a spacer 390 disposed against a work surface 392.

Figure 12:
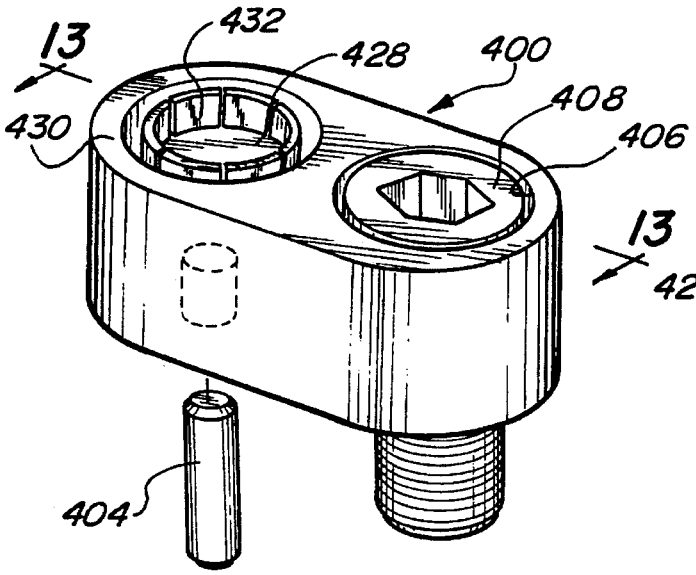
FIG. 12 is a perspective view showing a fourth preferred embodiment of a die assembly and die retainer employed in the apparatus of the present invention of FIG. 1.
Figure 14:
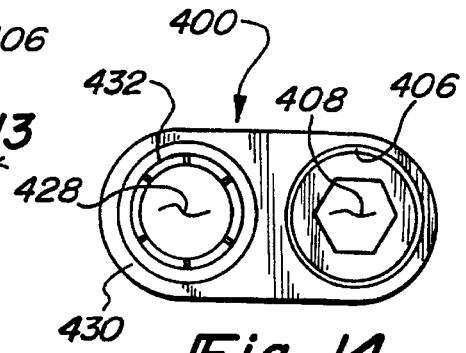
FIG. 14 is a top elevational view showing the fourth preferred embodiment of the die assembly and die retainer of FIG. 12 employed in the apparatus of the present invention.
Figure 13:
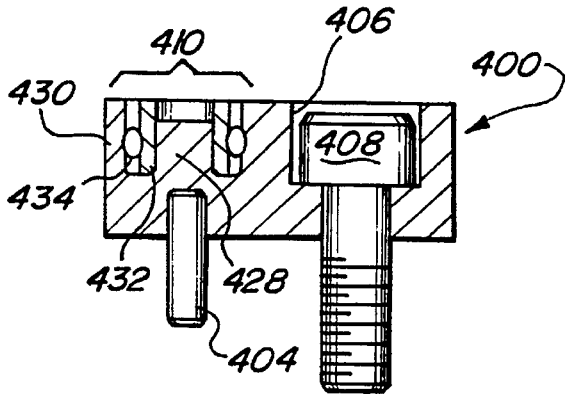
FIG. 13 is a sectional view, taken along line 13—13 of FIG. 12, showing the fourth preferred embodiment of the die assembly and die retainer employed in the apparatus of the present invention.

FIGS. 12 through 14 show a fourth embodiment of the apparatus of the present invention as having a die retainer 400 which is integral with an outer sleeve 430. Outer sleeve 430, an anvil 428, a plurality of die segments 432 and a canted spring 434 define a die assembly 410. Anvil 428, die segments 432 and spring 434 are substantially the same as that of the prior embodiments. A bolt 408 is mounted within a stepped aperture 406 of die retainer 400 for attachment to an adjacent work surface 122 (see FIG. 1). A cylindrical locating pin 404 is also provided.

Figure 17:
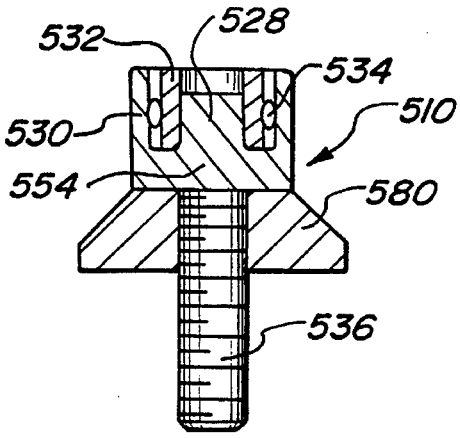
FIG. 17 is a sectional view, taken along line 17—17 of FIG. 16, showing the fifth preferred embodiment of the combined die assembly and die retainer employed in the apparatus of the present invention.
Figure 15:
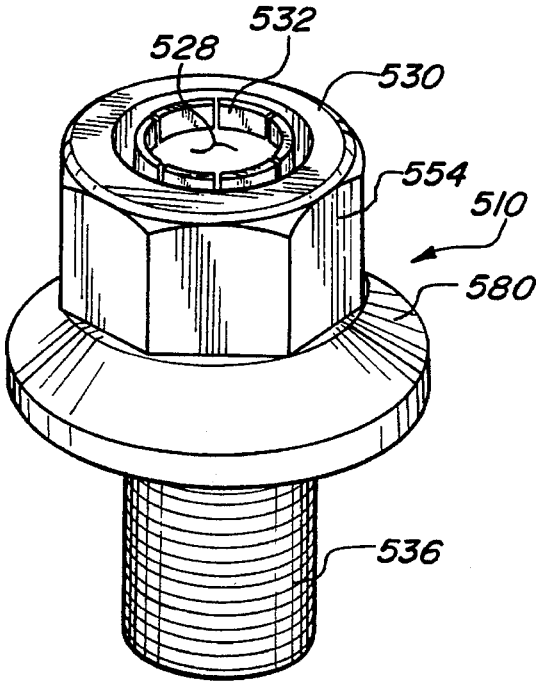
FIG. 15 is a perspective view showing a fifth preferred embodiment of a combined die assembly and die retainer employed in the apparatus of the present invention of FIG. 1.
Figure 16:
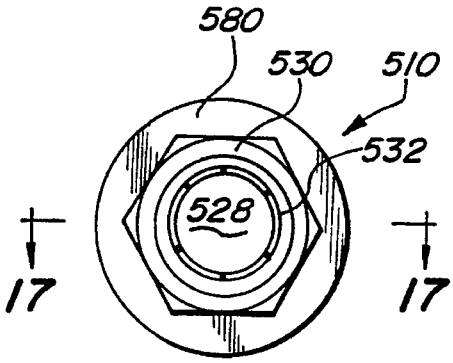
FIG. 16 is a top elevational view showing the fifth preferred embodiment of the combined die assembly and die retainer of FIG. 15 employed in the apparatus of the present invention.

Referring now to FIGS. 15 through 17, a fifth preferred embodiment of the apparatus of the present invention provides a combined die assembly and retainer 510. An anvil 528, sleeve 530, die segments 532 and canted spring 534 are substantially identical to that of the first preferred embodiment. Moreover, a threaded shaft 536 extends from a base portion 554 and through a tapered spacer or skirt 580 for enmeshed engagement to a work surface 122 (see FIG. 1 ). A separate bolt is not required for fastening.

It will be apparent to one skilled in the art that the present invention offers many advantages over the prior art devices. First, the canted spring provides an easily expandable retainer around the plurality of die segments. Additionally, the canted spring allows for easier effort and greater radial expansion by the die segments. Additionally, the canted spring serves to secure the die segments within the outer sleeve. Notwithstanding, a variety of other non-canted or even non-coiled springs may be employed to retain a plurality of die segments within an outer sleeve. For example, a series of leaf or compression springs may be inserted between each die segment and the adjacent portion of the outer sleeve.

The outer sleeve used in the apparatus of the present invention also provides advantages over prior art devices. The present invention outer sleeve prevents foreign material such as dirt, metal scrap or grease from entering the spring, die segments or anvil. Moreover, the outer sleeve serves to protect the spring and die segments from inadvertent impacts caused by misalignment of material sheets entering between the punch and the die assembly or from other nearby equipment. The outer sleeve also serves as a radial expansion limiter for the spring and the die segments. Further, the outer sleeve has a base portion which can be hexagonally or otherwise shaped for engagement with a wrench or other torque providing tool to aid in assembly and disassembly. The die assembly of the present invention additionally employs a variety of securing means for mounting to a die retainer. Thus, a compact, integrated, easily manufactured, easily disassemblable, low cost die assembly is achieved.

The present invention also provides for the unique set of die retainers which serve to secure a die assembly to a work surface. This is advantageously achieved through the use of a receptacle, fastening means, and an optional locator pin, constructed in a variety of rigid yet easily assembled and disassembled constructions. Various spacers or tapered skirts can also be employed to isolate vibration and to vary functional height of the die assembly.

While the preferred embodiments of this apparatus for joining sheets of material have been disclosed, it will be appreciated that various modifications may be made without departing from the present invention. For example, a die retainer can be constructed in a manner similar to those disclosed which can secure multiple die assemblies to a work surface. Furthermore, while specific press fit and threaded fasteners have been shown between a die assembly and a die retainer, other suitable retention means may be employed. Moreover, a locator rib or formation may be substituted for the inserted locator pin within the disclosed die retainer. Other material joining punches and anvils can be used with the present invention apparatus. While various materials have been disclosed in an exemplary fashion, a variety of other materials may of course be employed. It is intended by the following claims to cover these and any other departures from the disclosed embodiments which fall within the true spirit of this invention.

The invention claimed is:

1. An apparatus for joining sheets of material comprising:

an anvil having a working surface and a peripheral surface;

a plurality of die segments each having a shoulder surface, an inside surface and an outside surface, said inside surfaces being disposed against said peripheral surface of said anvil prior to forming a joint;

a canted coiled spring substantially surrounding a portion of said outside surfaces of said plurality of die segments whereby said plurality of die segments are radially urged toward said anvil, said plurality of die segments being expandably movable in a transverse direction away from said anvil during forming of said joint;

an outer sleeve having an inner surface substantially surrounding said outside surfaces of said plurality of die segments and said spring, said outer sleeve allowing said plurality of die segments to transversely move; and said canted coiled spring contacting against said outer sleeve and said plurality of die segments,

2. The apparatus of claim 1 wherein:

said spring engagably secures said plurality of die segments within said outer sleeve.

3. The apparatus of claim 2 further comprising:

a groove transversely disposed along said outside surfaces of said plurality of die segments;

a channel transversely disposed along said inner surface of said sleeve; and said spring interfacing within said groove of said plurality of die segments and within said channel of said sleeve.

4. The apparatus of claim 3 wherein:

said groove has a substantially elliptical cross section; and said channel has a substantially elliptical cross section thereto.

5. The apparatus of claim 1 wherein:

said anvil, plurality of die segments, spring and outer sleeve define a die assembly.

6. The apparatus of claim 5 further comprising:

a die retainer retaining said die assembly and having means for fastening said die retainer to a work surface.

7. The apparatus of claim 6 wherein:

said die retainer further having a receptacle within which at least a portion of said die assembly is secured.

8. The apparatus of claim 7 wherein:

said fastening means includes a threaded shaft.

9. The apparatus of claim 8 wherein:

said threaded shaft of said fastening means is a separately installed bolt longitudinally displaced partially through an aperture within said die retainer.

10. The apparatus of claim 9 further comprising:

said fastening means further includes a second bolt projecting substantially parallel to said first bolt and at least partially through a second aperture within said die retainer.

11. The apparatus of claim 10 wherein:

said die retainer is constructed with a locating member and said bolts disposed triangularly adjacent to one another when viewed from the top.

12. The apparatus of claim 10 wherein:

said die retainer is constructed with said receptacle and said bolts disposed triangularly adjacent to one another when viewed from the top.

13. The apparatus of claim 7 wherein: said receptacle is internally threaded for enmeshed engagement with a threaded shaft projecting from said die assembly.

14. The apparatus of claim 7 wherein;

said receptacle of said die retainer is located within an elongated tower projecting from a portion of said die retainer having said fastening means.

15. The apparatus of claim 14 further comprising:

a set screw transversely extending through a portion of said tower of said die retainer, a point of said set screw engaging an indentation located within an outer surface of said die assembly whereby said die assembly is secured to said die retainer.

16. The apparatus of claim 6 further comprising:

a locating member longitudinally projecting from said die retainer, said locating member serving to locate said die retainer to said work surface.

17. The apparatus of claim 6 further comprising:

a spacer juxtapositioned between said die retainer and said work surface.

18. The apparatus of claim 17 wherein:

said spacer has a tapered configuration and has a passage through which said fastening means extends.

19. The apparatus of claim 5 further comprising:

a threaded shaft longitudinally projecting from said die assembly substantially coaxially aligned with said anvil.

20. The apparatus of claim 5 further comprising:

a threaded passage extending within said die assembly substantially coaxial with said anvil; and a die-securing bolt having a threaded shaft and a head, said threaded shaft of said die-securing bolt engaging with said threaded passage within said die assembly, said head of said die-securing bolt being secured to said die retainer.

21. The apparatus of claim 20 wherein said die retainer includes:

a hollow central insert disposed within at least a portion of said die retainer, a portion of said shaft of said die-securing bolt extending through said central insert with said head being secured against a portion of said central insert.

22. The apparatus of claim 5 wherein:

an outer surface of said die assembly has a hexagonal configuration.

23. The apparatus of claim 1 wherein:

said peripheral surface of said anvil is cylindrically shaped; and said inside surfaces of said plurality of die segments have an arcuate configuration.

24. The apparatus of claim 1 wherein:

said shoulder surfaces of said plurality of die segments longitudinally project beyond said working surface of said anvil.

25. The apparatus of claim 1 farther comprising:

a punch assembly having a punch with a working surface movably opposing said working surface of said anvil, said punch acting to deform said sheets of material against said working surface of said anvil and substantially between said plurality of die segments, said punch, anvil and plurality of die segments serving to create a joint between said sheets of material.

26. The apparatus of claim 1 wherein:

said sheets of material include a sheet metal material.

27. The apparatus of claim 1 wherein:

said sheets of material include a deformable polymeric material.

28. An apparatus for joining sheets of material comprising:

an anvil having a working surface and a peripheral surface;

a plurality of die segments each having a shoulder surface, an inside surface and an outside surface, said inside surfaces of said plurality of die segments being disposed against said peripheral surface of said anvil prior to forming a joint;

a spring substantially surrounding a portion of said outside surfaces of said plurality of die segments whereby said plurality of die segments are transversely urged toward said anvil, said plurality of die segments being expandably movable in a transverse direction away from said anvil during forming of said joint; and an outer sleeve having an inner surface substantially surrounding said outside surfaces of said plurality of die segments and said spring, said outer sleeve allowing said plurality of die segments to transversely move, said outer sleeve having an upper edge projecting at least as high as a plane defined by said shoulder surfaces of said plurality of die segments.

29. The apparatus of claim 28 wherein:

said spring is a canted and coiled spring.

30. The apparatus of claim 28 wherein:

said spring engagably secures said plurality of die segments within said outer sleeve.

31. The apparatus of claim 30 further comprising:

a groove transversely disposed along said outside surfaces of said plurality of die segments;

a channel transversely disposed along said inner surface of said sleeve; and said spring interfacing within said groove of said plurality of die segments and within said channel of said sleeve.

32. The apparatus of claim 28 wherein:

said anvil, plurality of die segments, spring and outer sleeve define a die assembly.

33. The apparatus of claim 32 further comprising:

a die retainer retaining said die assembly and having means for fastening said die retainer to a work surface.

34. The apparatus of claim 33 wherein:

said die retainer further having a receptacle within which at least a portion of said die assembly is secured.

35. The apparatus of claim 34 wherein:

said fastening means includes a threaded shaft.

36. The apparatus of claim 35 wherein:

said threaded shaft of said fastening means is a separately installed bolt longitudinally displaced partially through an aperture within said die retainer.

37. The apparatus of claim 36 further comprising:

said fastening .means further includes a second bolt projecting substantially parallel to said first bolt and at least partially through a second aperture within said die retainer.

38. The apparatus of claim 37 wherein:

said die retainer is constructed with a locating member and said bolts disposed triangularly adjacent to one another when viewed from the top.

39. The apparatus of claim 37 wherein:

said die retainer is constructed with said receptacle and said bolts disposed triangularly adjacent to one another when viewed from the top.

40. The apparatus of claim 34 wherein: said receptacle is internally threaded for enmeshed engagement with a threaded shaft projecting from said die assembly.

41. The apparatus of claim 34 wherein:

said receptacle of said die retainer is located within an elongated tower projecting from a portion of said die retainer having said fastening means.

42. The apparatus of claim 41 further comprising:

a set screw transversely extending through a portion of said tower of said die retainer, a point of said set screw engaging an indentation located within an outer surface of said die assembly whereby said die assembly is secured to said die retainer.

43. The apparatus of claim 33 further comprising:

a locating member longitudinally projecting from said die retainer, said locating member serving to locate said die retainer to said work surface.

44. The apparatus of claim 33 further comprising:

a spacer juxtapositioned between said die retainer and said work surface.

45. The apparatus of claim 44 wherein:

said spacer has a tapered configuration and has a passage through which said fastening means extends.

46. The apparatus of claim 32 further comprising: a threaded shaft longitudinally projecting from said die assembly substantially coaxially aligned with said anvil.

47. The apparatus of claim 32 further comprising:

a threaded passage extending within said die assembly substantially coaxial with said anvil; and a die-securing bolt having a threaded shaft and a head, said threaded shaft of said die-securing bolt engaging with said threaded passage within said die assembly, said head of said die-securing bolt being secured to said die retainer.

48. The apparatus of claim 47 wherein said retainer includes:

a hollow central insert disposed within at least a portion of said die retainer, a portion of said shaft of said die-securing bolt extending through said central insert with said head being secured against a portion of said central insert.

49. The apparatus of claim 32 wherein:

an outer surface of said die assembly has a hexagonal configuration.

50. The apparatus of claim 28 wherein:

said peripheral surface of said anvil is cylindrically shaped; and said inside surfaces of said plurality of die segments have an arcuate configuration.

51. The apparatus of claim 28 wherein:

said shoulder surfaces of said plurality of die segments longitudinally project beyond said working surface of said anvil.

52. The apparatus of claim 28 further comprising:

a punch assembly having a punch with a working surface movably opposing said working surface of said anvil, said punch acting to deform said sheets of material against said working surface of said anvil and substantially between said plurality of die segments, said punch, anvil and plurality of die segments serving to create a joint between said sheets of material.

53. The apparatus of claim 28 wherein:

said sheets of material include a sheet metal material.

54. The apparatus of claim 28 wherein:

said sheets of material include a deformable polymeric material.

55. An apparatus for joining sheets of material comprising:

an anvil having a working surface and a peripheral surface;

a plurality of die segments each having a shoulder surface, an inside surface and an outside surface, said inside surfaces of said plurality of die segments being disposed against said peripheral surface of said anvil prior to forming a joint, said shoulder surfaces of said plurality of die segments longitudinally projecting beyond said working surface of said anvil;

a spring substantially surrounding a portion of said outside surfaces of said plurality of die segments whereby said plurality of die segments are transversely urged toward said anvil, said plurality of die segments being expandably movable in a transverse direction away from said anvil during forming of said joint, said spring being defined as a canted and coiled spring;

an outer sleeve having an inner surface substantially surrounding said outside surfaces of said plurality of die segments and said spring, said outer sleeve allowing said plurality of die segments to transversely move, said spring engagably securing said plurality of die segments within said outer sleeve;

a die retainer having means for fastening said die retainer to a work surface, said die retainer having a receptacle within which at least a portion of said outer sleeve is secured; and a punch assembly having a punch with a working surface movably opposing said working surface of said anvil, said punch acting to deform said sheets of material against said working surface of said anvil and substantially between said plurality of die segments, said punch, anvil and plurality of die segments sewing to create a joint between said sheets of material, said sheets of material including a sheet metal material.

56. A die assembly employed within an apparatus for joining sheets of material, said die assembly comprising:

means for abutting at least one of said sheets of material, said abutting means having a working surface and a peripheral surface;

means for supporting at least one of said sheets of material, said supporting means having a shoulder surface, an inside surface and an outside surface, said inside surfaces being disposed against said peripheral surface of said abutting means prior to forming a joint;

means for urging said supporting means toward said abutting means, said supporting means being expandably movable in a transverse direction away from said abutting means during forming of said joint; and means for protecting said supporting means and said urging means substantially surrounding said outside surfaces of said supporting means and said urging means, said urging means disposed within a single channel of said protecting means.

57. The die assembly of claim 56 wherein:

said urging means is a canted and coiled spring.

58. An apparatus for joining sheets of material comprising:

an anvil having a working surface and a peripheral surface;

a plurality of die segments each having a shoulder surface, an inside surface and an outside surface, said inside surfaces of said plurality of die segments being disposed against said peripheral surface of said anvil prior to forming a joint;

a spring substantially surrounding a portion of said outside surfaces of said plurality of die segments whereby said plurality of die segments are transversely urged toward said anvil, said plurality of die segments being expandably movable in a transverse direction away from said anvil during forming of said joint;

an outer sleeve having an inner surface substantially surrounding said outside surfaces of said plurality of die segments and said spring, said outer sleeve allowing said plurality of die segments to transversely move;

said anvil, plurality of die segments, spring and outer sleeve defining a die assembly; and an outer surface of said die assembly having a hexagonal configuration.

59. An apparatus for Joining sheets of material comprising:

an anvil having a working surface and a peripheral surface;

a plurality of die segments each having a shoulder surface, an inside surface and an outside surface, said inside surfaces of said plurality of die segments being disposed against said peripheral surface of said anvil prior to forming a joint;

a spring substantially surrounding a portion of said outside surfaces of said plurality of die segments whereby said plurality of die segments are transversely urged toward said anvil, said plurality of die segments being expandably movable in a transverse direction away from said anvil during forming of said joint;

an outer sleeve having an inner surface substantially surrounding aid outside surfaces of said plurality of die segments and said spring, said outer sleeve allowing said plurality of die segments to transversely move;

said anvil, plurality of die segments, spring and outer sleeve defining a die assembly;

a die retainer having means for fastening said die retainer to a work surface; and a spacer juxtapositioned between said die retainer and said work surface.

* * * * *

UNITED STATES PATENT AND TRADEMARK OFFICE

CERTIFICATE OF CORRECTION

PATENT NO. : 5,479,687
DATED : January 2, 1996
INVENTOR(S) : Edwin G. Sawdon

It is certified that error appears in the above-indentified patent and that said Letters Patent is hereby corrected as shown below:

On the title page, under Attorney, Agent, or Firm, "Harness, Dickey & Pierce" should be -- Harness, Dickey & Pierce, P.L.C. --.

Column 1, line 25, "Tog- L-Loc® should be -- Tog-L-Loc®--.

Column 3, line 14, "a and b" should be -- *a and b* --.

Column 3, line 67, "a and b" should be -- *a and b* --.

Column 6, line 15, "," should be -- . --.

Column 6, line 30, delete "thereto".

Column 6, line 61, begin new paragraph with "said".

Column 6, line 64, ";" should be -- : --.

Column 7, line 50, "farther" should be -- further --.

Column 8, line 48, ".means" should be -- means --.

Column 8, line 61, begin new paragraph with "said".

Column 10, line 35, "sewing" should be -- serving --.

UNITED STATES PATENT AND TRADEMARK OFFICE

CERTIFICATE OF CORRECTION

PATENT NO. : 5,479,687

DATED : January 2, 1996

INVENTOR(S) : Edwin G. Sawdon

It is certified that error appears in the above-indentified patent and that said Letters Patent is hereby corrected as shown below:

Column 11, line 19, "Joining" should be -- joining --.

Column 12, line 13, "aid" should be -- said --.

Signed and Sealed this

Sixteenth Day of July, 1996

*Attest:*

*Attesting Officer*

BRUCE LEHMAN

*Commissioner of Patents and Trademarks*